US008448419B2

(12) United States Patent
Demmons et al.

(10) Patent No.: US 8,448,419 B2
(45) Date of Patent: May 28, 2013

(54) ELECTROSPRAY SOURCE

(75) Inventors: Nathaniel Demmons, Mason, NH (US); Vlad Hruby, Newton, MA (US); Douglas Spence, Brookline, MA (US); Thomas Roy, Auburndale, MA (US)

(73) Assignee: Busek Company, Inc., Natick, MA (US)

( * ) Notice: Subject to any disclaimer, the term of this patent is extended or adjusted under 35 U.S.C. 154(b) by 994 days.

(21) Appl. No.: 12/228,909

(22) Filed: Aug. 18, 2008

(65) Prior Publication Data

US 2009/0113872 A1 May 7, 2009

Related U.S. Application Data

(60) Provisional application No. 60/965,664, filed on Aug. 21, 2007.

(51) Int. Cl.

| | |
|---|---|
| ***F03H 1/00*** | (2006.01) |
| ***B63H 11/00*** | (2006.01) |
| ***H01J 17/26*** | (2012.01) |

(52) U.S. Cl.
USPC ..... 60/202; 60/203.1; 60/204; 313/231.01

(58) Field of Classification Search
USPC ..... 60/39.461, 202, 203.1, 204, 772; 239/3, 239/696; 313/231.01, 231.31; 315/111.81; 118/723 R, 723 CB, 723 EB
See application file for complete search history.

(56) References Cited

U.S. PATENT DOCUMENTS

| | | | | |
|---|---|---|---|---|
| 3,262,262 | A * | 7/1966 | Reader et al. | 60/202 |
| 3,552,124 | A * | 1/1971 | Banks et al. | 60/202 |
| 4,328,667 | A * | 5/1982 | Valentian et al. | 60/202 |
| 4,680,507 | A * | 7/1987 | Uemura et al. | 315/111.81 |
| 4,783,595 | A * | 11/1988 | Seidl | 250/423 R |
| 6,474,573 | B1 * | 11/2002 | Kelly | 239/690 |
| 6,516,604 | B2 * | 2/2003 | Mojarradi et al. | 60/202 |
| 6,729,552 | B1 * | 5/2004 | McEwen et al. | 239/49 |
| 6,996,972 | B2 | 2/2006 | Song | |

* cited by examiner

*Primary Examiner* — William H Rodriguez
*Assistant Examiner* — Arun Goyal
(74) *Attorney, Agent, or Firm* — Iandiorio Teska & Coleman LLP

(57) ABSTRACT

An electrospray source useful for a variety of applications and including an emitter with a porous media flow distributor having a surface forming multiple Taylor cones. A casing about the porous media flow distributor controls the direction of a working fluid through the porous media. An extractor is at a potential different than the emitter for forming the Taylor cones. A guard electrode is disposed between the emitter and the extractor and is at or above the potential of the emitter for shaping the electric field formed between the emitter and the extractor.

23 Claims, 6 Drawing Sheets

ELECTROSPRAY SOURCE

RELATED APPLICATIONS

This application hereby claims the benefit of and priority to U.S. Provisional Application Ser. No. 60/965,664, filed on Aug. 21, 2007 incorporated herein by this reference.

GOVERNMENT RIGHTS

This invention was made with U.S. Government support under Contract No. FA9300-04-M-3102 awarded by the U.S. Air Force. The Government has certain rights in the invention.

FIELD OF THE INVENTION

The subject invention relates to electrospray technology.

BACKGROUND OF THE INVENTION

Electrospray sources are used in a variety of applications. U.S. Pat. No. 6,996,972 (incorporated herein by this reference), for example, discloses an electromagnetic spacecraft thruster with two showerheads each producing multiple jets. Each showerhead includes hundreds of micro-nozzles. Each micro-nozzle includes a conductive metallic layer coated with a thin insulative layer to form a frustum-shaped or conic truncated apex tip outlet resulting in a jet-producing Taylor cone of propellant. The inner diameter of each micro-nozzle is typically less than 100 nanometers.

The construction of such a shower head with numerous micro-nozzles is not elementary. Also, the showerhead is rather large and bulky. Still, a need exists in thrusters and in other applications for an electrospray source which produces multiple jets of a working fluid.

BRIEF SUMMARY OF THE INVENTION

It is therefore an object of this invention to provide a new electrospray source.

It is a further object of this invention to provide such an electrospray source which does not require the manufacturing and assembly of numerous micro-nozzles.

It is a further object of this invention to provide such an electrospray source which produces multiple jets of a working fluid.

It is a further object of this invention to provide such an electrospray source which is compact in size.

It is a further object of this invention to provide a novel electrospray source which is easier to manufacture and which can be manufactured at a lower cost.

It is a further object of this invention to provide such an electrospray source which provides a more uniform flow distribution.

It is a further object of this invention to provide such an electrospray source which produces a higher density emission.

It is a further object of this invention to provide such a new electrospray source which is durable.

It is a further object of this invention to provide such an electrospray source which is capable of multimode operation.

It is a further object of this invention to provide such an electrospray source which can be used in connection with thrusters and other atomizer applications.

It is a further object of this invention to provide a novel method of making an electrospray source.

The subject invention results, at least in part, from the realization that instead of assembling numerous micro-nozzles in order to produce multiple Taylor cones of a working fluid (e.g., a propellant), a porous media can be used to distribute the flow of the working fluid to form multiple Taylor cones.

The subject invention features an electrospray source comprising an emitter including a porous media flow distributor with a surface forming multiple Taylor cones and a casing about the porous media flow distributor for controlling the direction of a working fluid through the porous media. An extractor is at a potential different than the emitter for forming the Taylor cones. A guard electrode is between the emitter and the extractor and at or above the potential of the emitter for shaping the electric field formed between the emitter and the extractor.

In one preferred embodiment, the porous media source includes sintered particles. In one example, the parties are stainless steel and have a porosity between 0.5 and 20 microns. Typically, the casing is made of the same materials as the sintered particles.

In one embodiment, the particles are sintered within the casing. In another example, sintered particles are attached (e.g., welded) to the casing. The surface of the porous flow distributor may have a concave shape. Typically, the extractor and the guard electrode are made of a conductive material. Further included may be a dielectric isolator between the extractor and the emitter.

One electrospray source emitter in accordance with the subject invention features a casing for controlling the direction of a working fluid and a porous media flow distributor associated with the casing and including a surface forming multiple Taylor cones when the working fluid flows through the porous media.

A thruster in accordance with the subject invention features an electrospray source including an emitter including a porous media flow distributor with a surface forming multiple Taylor cones. An extractor is at a potential different than the emitter forming the Taylor cones and a guard electrode is isolated between the emitter and the extractor at or above the potential of the emitter for shaping the electric field formed between the emitter and the extractor.

The subject invention also features a method of producing multiple Taylor cones of a working fluid. The preferred method includes a driving the working fluid through a porous media and producing an electric filed to form multiple Taylor cones of the working fluid emitted from the porous media. The method may further include shaping the electric field.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
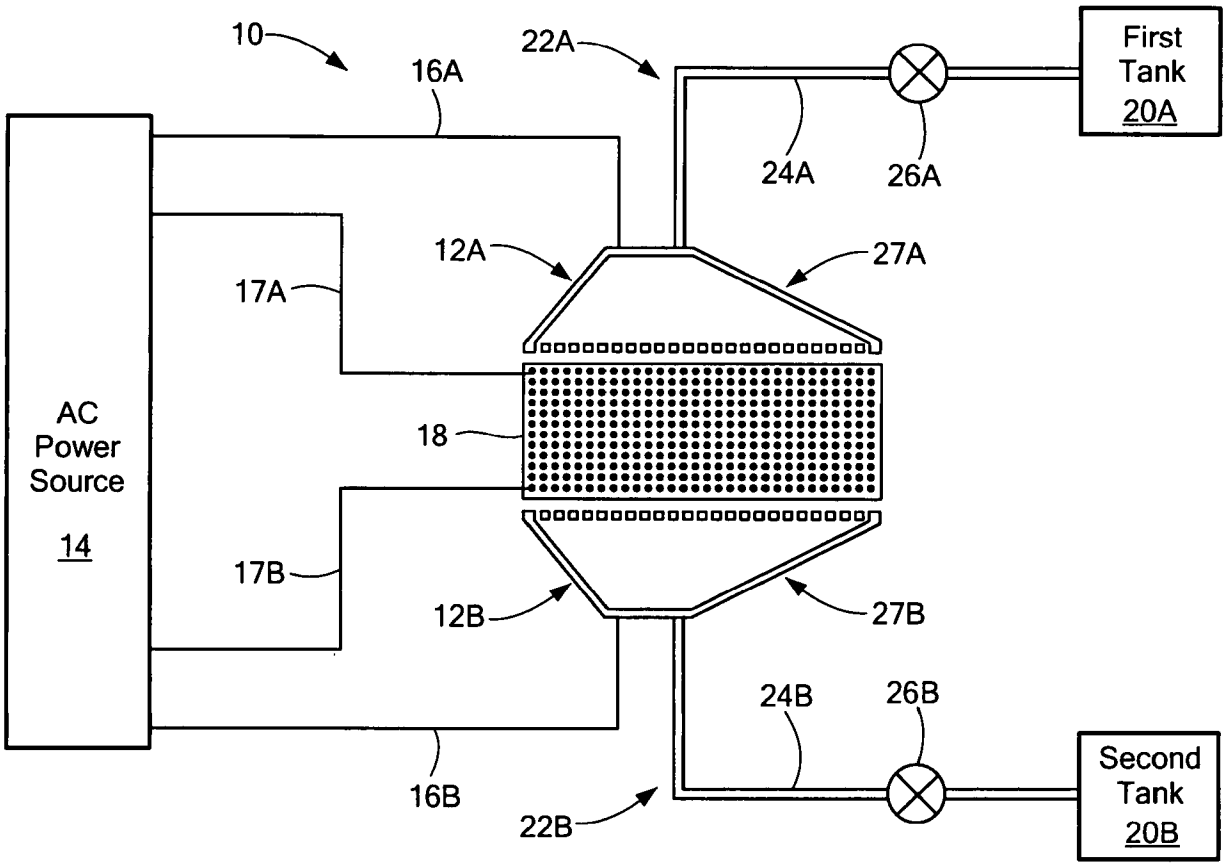
FIG. 1 PRIOR ART
FIG. 1 is a schematic block diagram showing the primary components associated with a prior art electromagnetic thruster.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 depicts a prior electromagnetic thruster 10 in accordance with U.S. Pat. No. 6,996,972. As disclosed in the patent, electromagnetic thruster 10 is useful for positioning and translating a spacecraft in space. Thruster 10 includes showerheads 12A and 12B, power source 14, magnetic field generator 18, two tanks 20A and 20B, and two conduit-and-valve systems 22A and 22B. Showerheads 12A and 12B largely comprise electrically conductive material and are arranged so that they at least partially face each other and cooperatively define a gap. The showerheads serve as emitters for dispensing amounts of ionized propellant (i.e., plasma) into the gap. Power source 14 is electrically interconnected between showerheads 12A and 12B via electrical conductors 16A and 16B at electrical connection points. Power source 14 serves to establish a difference in voltage potentials between the two showerheads 12A and 12B. An electric field is created in the gap. Magnetic field generator 18 is electrically connected to power source 14 via electrical conductors 17A and 17B. Tanks 20A and 20B are pressurized and together serve as reservoirs for storing liquid propellant. As shown in FIG. 1, each of the tanks is dedicated to supplying propellant under pressure to one of the showerheads.

Figure 2:
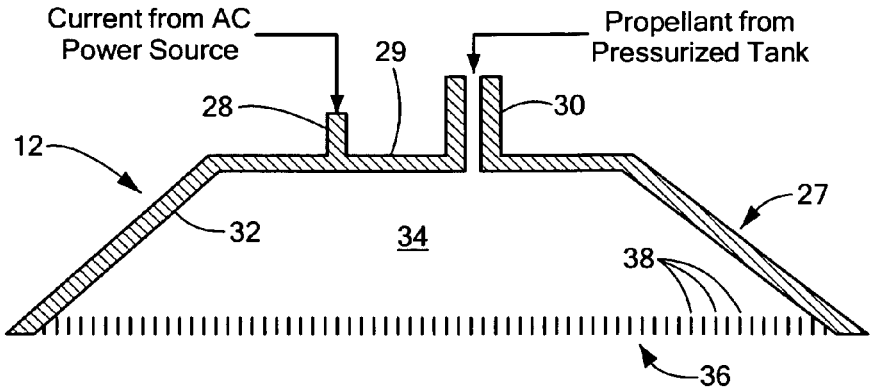
FIG. 2 PRIOR ART
FIG. 2 is a schematic cross-sectional view showing one of the shower heads of the thruster of FIG. 1.

FIG. 2 shows showerhead 12 including enclosure 27 and a plurality of micro-nozzles 38. The enclosure 27 has an electrically conductive outer wall 29, a chamber 34 defined within the outer wall 29, and an inlet 30 defined through the outer wall 29. The micro-nozzles 38 are collectively interspaced within a planar section of the outer wall 29 so as to define a face 36 on the showerhead 12. Together, the micro-nozzles 38 provide fluid communication between the chamber 34 and the outside of the showerhead 12. Each micro-nozzle is formed so as to include both a convergent inner surface associated with a conductive layer and a convergent inner surface associated with an insulative layer. The micro-nozzle has an overall inner surface that is substantially frustum-shaped or conic with a truncated apex that generally coincides with the tip outlet so that the inner surface of the nozzle substantially resembles a jet-producing Taylor cone. Propellant flows through the micro-nozzles to be emitted into the gap of the thruster.

As explained in the Background section above, construction of such a showerhead with numerous micro-nozzles can be difficult and the result is a rather large and bulky device for producing a number of Taylor cones.

Figure 3:
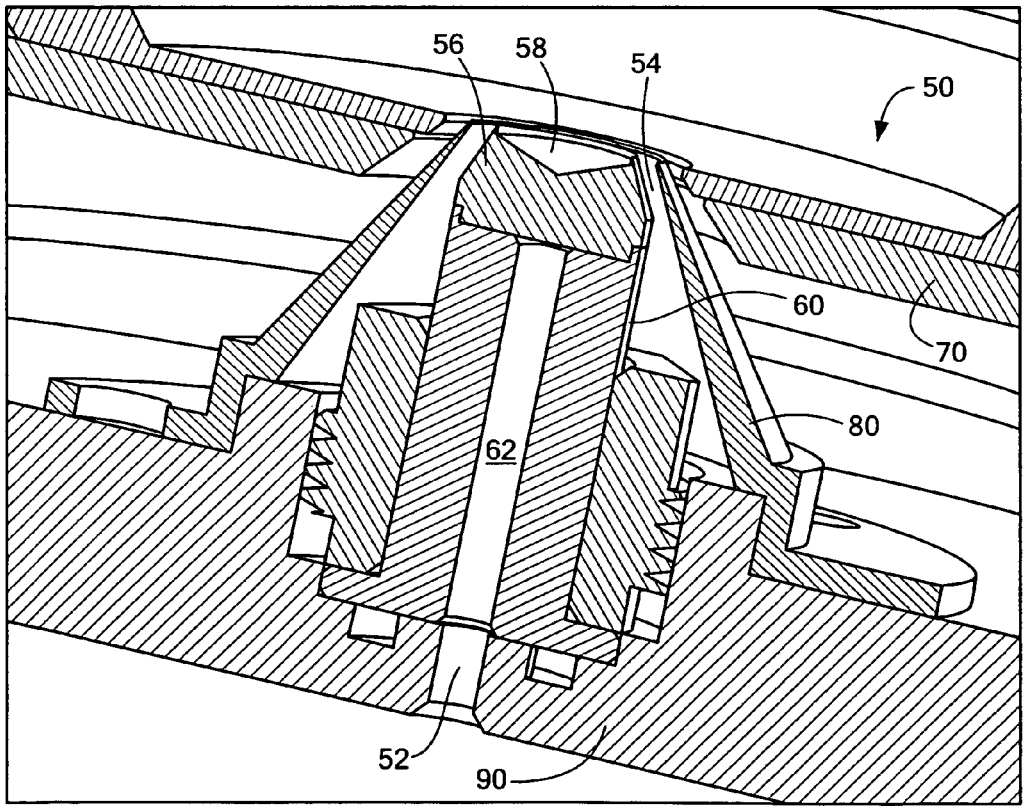
FIG. 3 is a schematic cross-sectional view showing the primary components associated with an example of an electrospray source in accordance with the subject invention.

FIG. 3 shows an example of a more compact electrospray source 50 producing multiple Taylor cones from a working fluid (e.g., a propellant) entering orifice 52. In this example, source 50 includes emitter 54 including porous media flow distributor 56 with a concave surface 58 forming multiple Taylor cones. Surface 58 need not be concave, however. It can be flat or include other features and/or shapes as desired by one skilled in the art. Emitter casing 60 controls the direction of flow of the working fluid through porous media 56. In one embodiment, a propellant (e.g., an ionic liquid) was fed by gas pressure to inlet 52, up through channel 62 incasing 60, and into structure 56. With an opposing extraction grid, the propellant exiting the emitter formed Taylor cones across surface 58.

Figure 4:
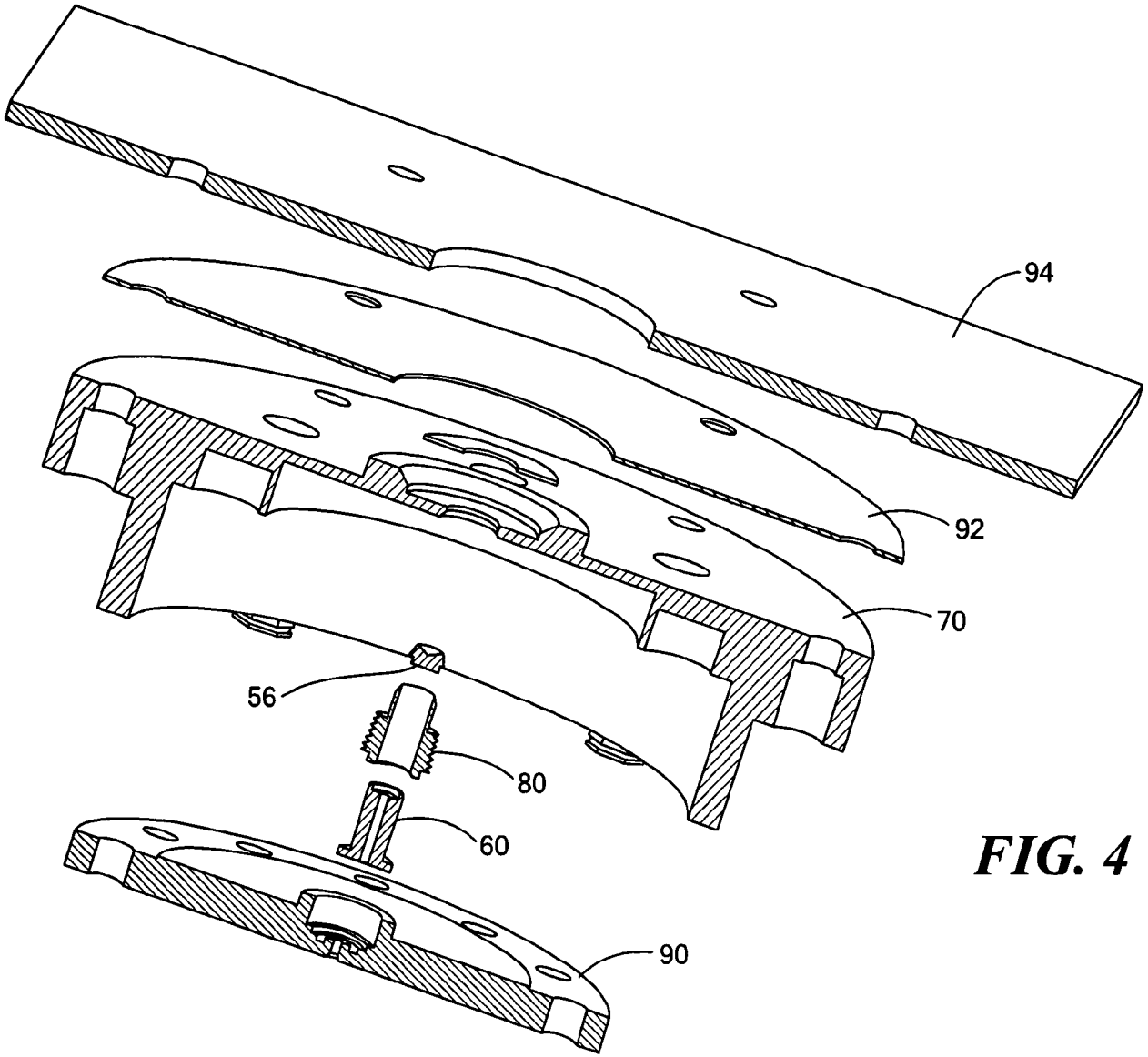
FIG. 4 is a schematic exploded view of the electrospray source shown in FIG. 3.

Porous media 58, in this example, including sintered stainless steel particles, was welded to casing 60. Extractor 70 is at a potential difference than emitter 54 for forming the Taylor cones and guard electrode 80 between emitter 54 and extractor 70 is at or above the potential of the emitter for shaping the electric field formed between the emitter and the extractor. Guard electrode 80 insures the working fluid is not sprayed on extractor 70. FIG. 4 shows an exploded view of electrospray source 50 and source flange 90, Teflon insulator 92, and ground mounting plate 94 in more detail.

The propellant chosen for this colloid thruster is the ionic liquid 1-ethyl-3-methylimidazolium bis(trifluoromethylsulfonyl) imide (EMI Im), which has conductivity K=0.84 S/m and density $\rho$=1530 kg/m$^3$. This propellant offers characteristics well suited for optimization of thrust, specific impulse and efficiency. Due to its low vapor pressure there are no propellant losses in vacuum due to evaporation.

FIG. 4 presents the basic thruster design including an electrospray source, extractor, and isolators. The electrospray source base was designed to support interchangeable electrospray sources. As seen in FIG. 4, the thruster was designed to mount to a grounded plate 94. Teflon insulating sheet 92 was placed between mounting plate 94 and extractor 70. This sheet protected the grounded plate from fasteners at high voltage on the isolator. The isolator was manufactured out of Ultem 1000, which was chosen for its excellent dielectric properties.

Source 56 was made of 60 a 5 micrometer porous frit of ~0.050" diameter, e-beam welded into supporting stem 60 configured with guard electrode 80. Platinum frits may also be used. The frits were custom machined by conventional and electric discharge machining (EDM) processes. Conventional machining was used on the cylindrical faces because it smeared the surface of the material, closing the pores. EDM machining was used for the bottom surface and the sharp rim of the emitter. EDM machining left the pores open for fluid flow. During operation, the propellant enters the upstream side of the frit and preferentially emerges along the rim of the emitter where it forms many emission sites along the perimeter.

A different guard electrode 80 was designed and manufactured to slip over the emitter as seen in FIG. 3.

The guard electrodes allow the emission surface to be located in the same plane as the extractor, thus substantially eliminating extractor contamination. The guard electrode forces local electric field near the face of the emitter to be axial which results in axial acceleration of the jet with a near zero radial component. This not only substantially eliminates extractor contamination but also may reduce the overall beam divergence.

Correct propellant driving pressures and beam voltage levels were determined and a wide range of beam currents were achieved. The emitter typically operated with beam currents ranging from 2.5 microAmps to 25 microAmps. The current collected by the extractor typically fell between 5 and 50 nanoAmps. The current measurements indicate two features. First, the high beam currents demonstrate very high electrospray emissions and a significant potential increase in available thrust than previously achieved using electrospray sources of such small size. Second, the low extractor currents show that negligible emissions are lost to the extractor.

The frit produced 25 to 100 emission points on the rim and in the central conical depression. This could prove useful in achieving higher beam currents from this type of electrospray source. The emission points tended to congregate on the rim and around its base. This would be expected because this region had the strongest electric field. The center of the conical depression was void of emission sites.

It was noted that as the flowrate was increased there were large oscillations corresponding with higher beam current levels. For example, at a nominal beam current of 6 microAmps, the current oscillated in a sinusoid with amplitude of 1 microAmp and a period of 15 seconds. Presumably, this could be linked to an unstable relation between electrospray emission and frit wetting effects. This was verified visually. The camera/microscope system used made it possible to observe a region of the frit surface where propellant was accumulating. There was a small portion of the emitter rim that was damaged during e-beam welding. This resulted in a depression where no electrospray emission sites existed. Here the fluid would accumulate until the bubble of propellant expanded into a region where emission sites did exist. At this point the excess propellant would immediately be drawn to the local emission sites and burned off. The process would then start again. This effect could be minimized by preventing emitter damage prior to operation and changing the emitter geometry to promote even distribution of emitter sites.

By examining the beam and extractor current data it can be inferred that the colloid thruster constructed operated primarily in a mixed ion/droplet mode. The evidence of this is in the comparison of the two currents. As stated above, the beam current oscillated at higher flowrates. Observation of the current collected by the extractor naturally oscillated in synchronization with the beam current, but opposite in direction. As beam current increased, extractor current decreased, and vice-versa. Because ions have greater mobility than droplets, they are more likely to be drawn to the extractor. Thus, the relation between the beam and extractor current can be seen as an oscillation between an ion/droplet mode and a more dominant droplet mode.

Delivered thrust was calculated based on an estimated number of electrospray emission points across the surface of the frit. By visual observation the number of emission sites was estimated to be between 25 and 100, depending on the operating conditions. The thruster constant C can be estimated by the following equation:

$$C_n = C_1\sqrt{\frac{n_1}{n_n}} \tag{1}$$

$$C_1 = 0.100$$

-continued $$n_1 = 1$$

$$n_n = 25 \ldots 100$$

$$C_{25} = 0.020$$

$$C_{100} = 0.010$$

where $C_1$ is the constant for a single electrospray emitter, $n_1$ the number of emitters for the constant $C_1$, and $C_n$ the constant for a thruster with n emission points. $C_1$ was already determined experimentally.

$$T = C_n I^{3/2} V^{1/2} \tag{2}$$

T=Thrust

I=Beam Current

V=Beam Voltage

Using equation 2, the thrust was estimated to be between 96.8 microNewtons and 193.6 microNewtons at 25 microAmps and 6 kV. Time constraints did not allow validation of this by direct thrust measurement.

Previous experiments and those reported here indicate that a source of the type shown in FIG. 3 can deliver thrust of the order of 100 microNewtons.

Thus, scaling to 1 milliNewton or larger thrust requires

An array of 10 sources of the type depicted in FIG. 3. This array might possibly fit into the 5 cm overall integrated source diameter. This approach is extremely practical.

The present source has a frit diameter of 0.050". This is a convenient and effective size resulting in good propellant transport to the rim where most emission occurs, but other sizes are possible. Metal foam could also be used as the porous media for the emitter.

In theory, the rim diameter could grow indefinitely. However fabrication tolerances, precision of assembly (affecting e.g. electric field distribution), and microscopic material properties (wetting) may impose a limit on the source size. Beyond that limit the emission becomes non-uniform and limits the total current to a level smaller than its uniformly emitting but smaller version.

Figure 5:
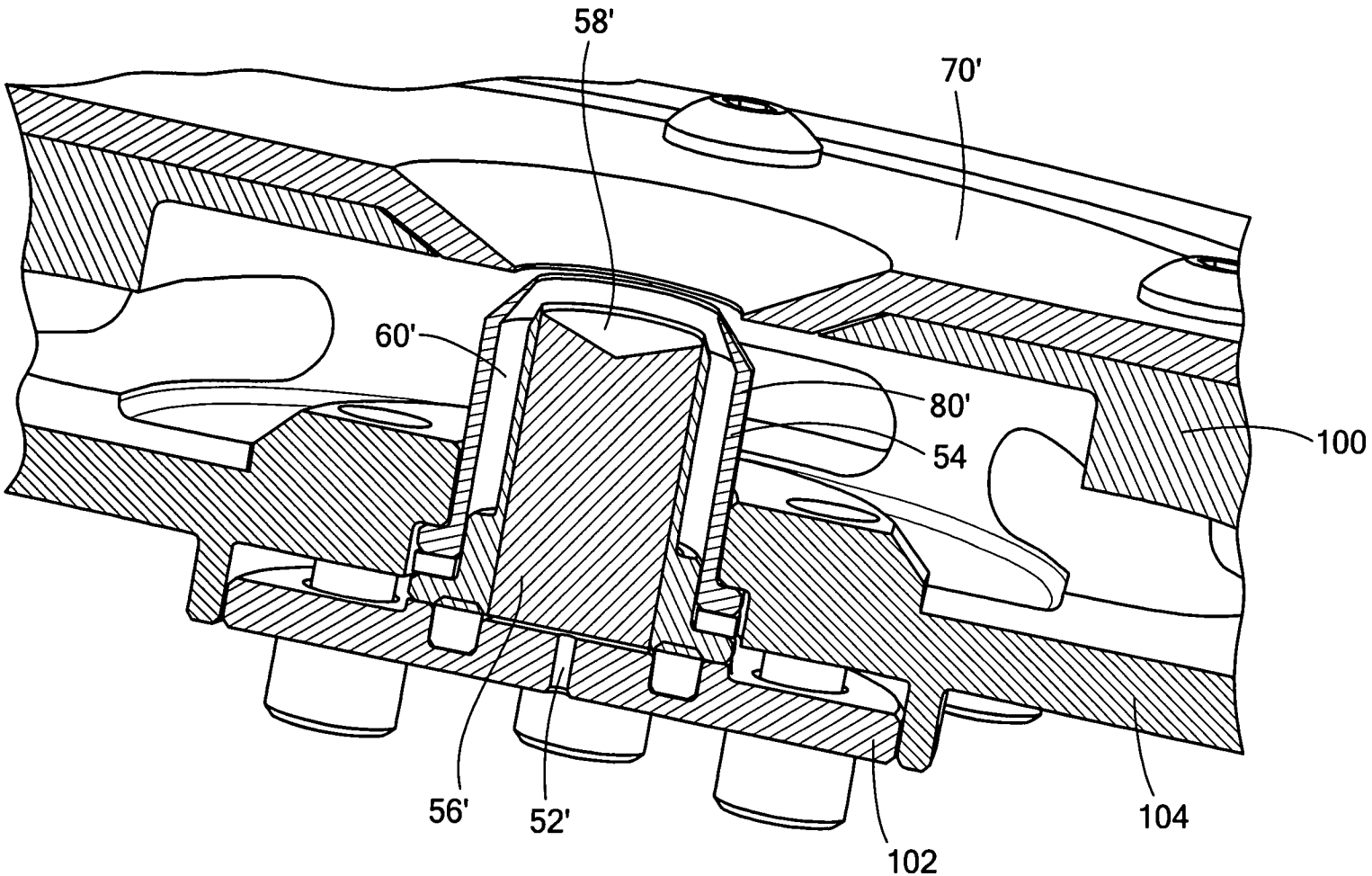
FIG. 5 is a schematic cross-sectional view showing the primary components associated with another example of an electrospray source in accordance with the subject invention.

In the particular example shown in FIG. 5, porous media flow distributor 56' is formed by sintering particles within casing 60'. Dielectric isolator 100 is located between extractor 70' and emitter 54. Base plate 102 and base 104 complete the assembly and serve to couple input 52' to stainless steel porous frit material 56'.

The typical sintered particles have a porosity between 0.5 and 20 microns. Casing 60' is preferably made of the same material as the sintered particles and, in this example, the casing was made of stainless steel. Extractor 70' is made of a conductive material as is guard electrode 80'.

The porous media is useful in high flow/high current electrospray emitters. Porous emitter 54 was designed and tested. Porous media or frits were directly sintered into casing 60'. Emissions surface 58' was manufactured by a process that did not damage the porous structure of the emitter. Propellant, an ionic liquid in this example was fed by gas pressure through inlet 52' to porous structure 56'. With an opposing extraction grid or extractor 70', the propellant exiting the emitter formed Taylor cones across surface 58' resulting in emission currents ranging up to 27 μA. Currents up to 100 μA have been achieved from the same emitter geometry. Surface 58' has an area of less than one square millimeter and yet produces up to 100 distinct emissions sites.

Figure 6:
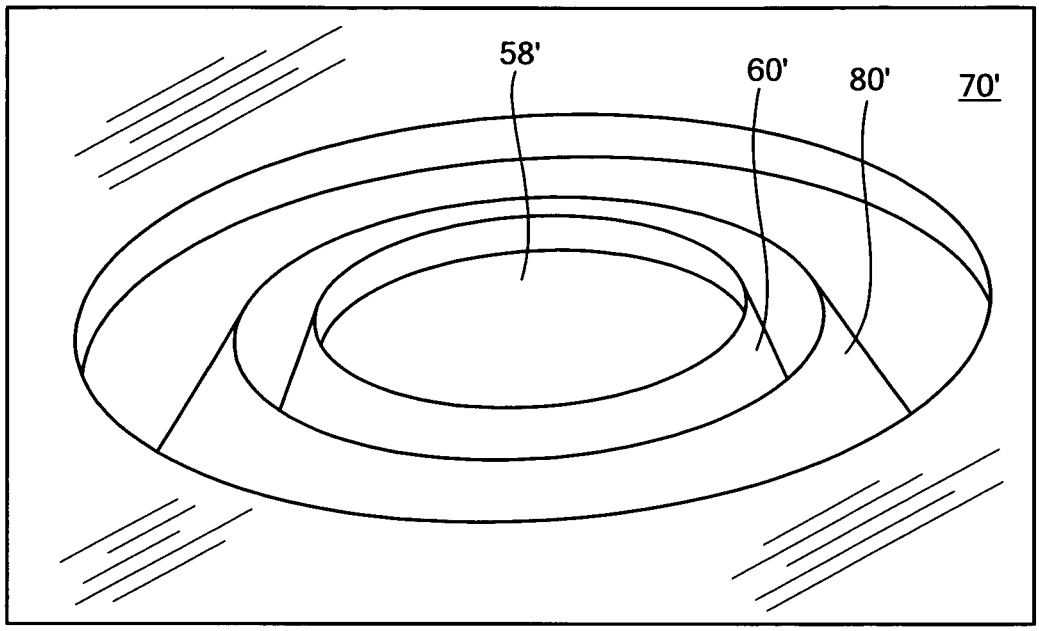
FIG. 6 is a schematic top view showing a porous media flow distributor in accordance with the subject invention.
Figure 7:
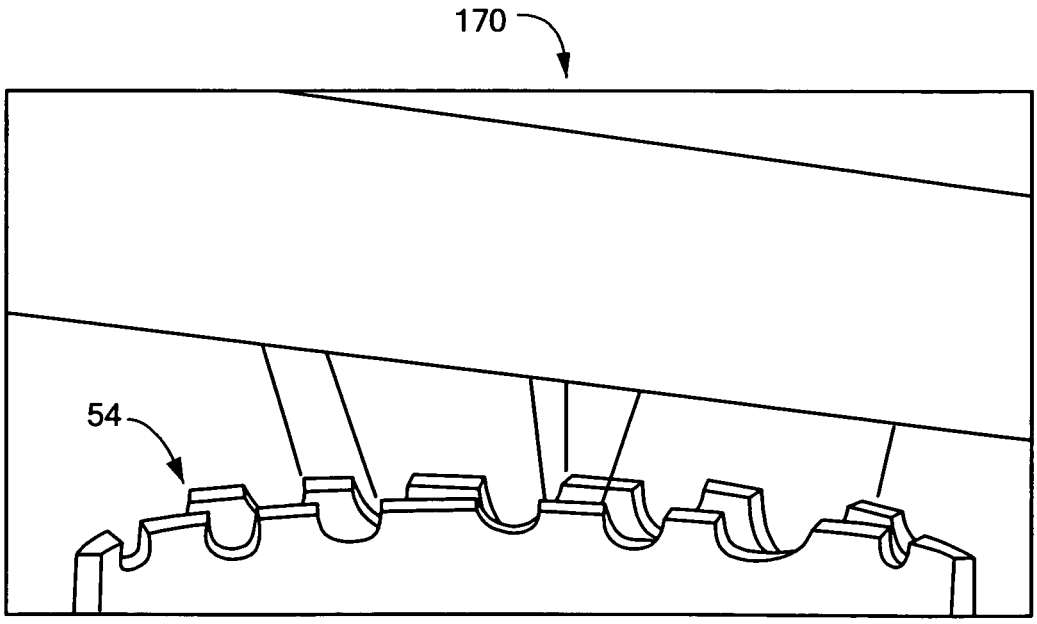
FIG. 7 is a schematic side view showing jets emanating from the emitter shown in FIG. 6.

FIG. 6 shows surface 58 of the porous media flow distributor within casing 60' surrounded by guard electrode 80' itself surrounded by extractor 70'. Hundreds of jets 120, FIG. 7 emanate from the emitter as shown.

Figure 8:
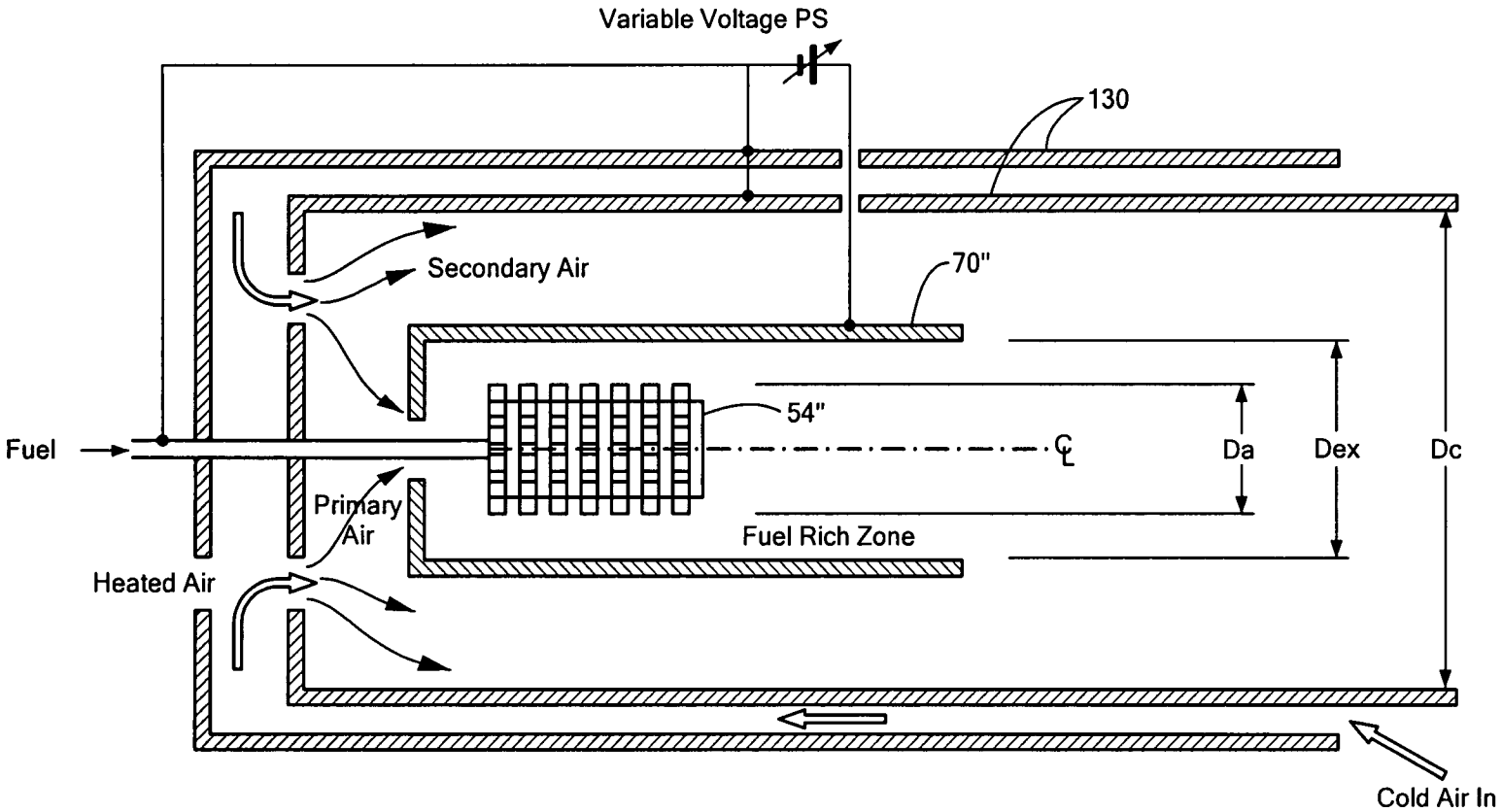
FIG. 8 is a highly schematic cross-sectional view showing an example of an electrospray atomizer in accordance with the subject invention used in connection with a combustor.

The result is a new electrospray source which does not require the manufacturing and assembly of numerous micro-nozzles. Thus far, the electrospray source has been described in connection with a thruster. FIG. 8 shows another use for electrospray source 54" in a combustor operating on jet fuel and including extractor 70" and ground metal shell 130. Other uses for multiple jet electrospray sources in accordance with the subject invention include coating or surface treatment applications, air purification, filtration, gas scrubber applications, and diagnostic and other aerosol applications. Also, porous media 56', FIG. 5 can extend down into a reservoir containing the working fluid and capillary action used to urge the working fluid through the porous media to the Taylor cone producing surface thereof.

Thus, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An electrospray source comprising:

an emitter including:

a porous media flow distributor with an inlet at one end thereof for working fluid intake, a surface including particles at the other end thereof, said particles serving as electric field concentration points to form multiple Taylor cones in said working fluid; and a casing about the porous media flow distributor for controlling the direction of said working fluid through the porous media;

an extractor at a potential different than the emitter for forming the Taylor cones; and a guard electrode surrounding the casing but spaced from the casing and between the emitter and the extractor, said guard electrode at or above the potential of the emitter for shaping the electric field formed between the emitter and the extractor.

2. The electrospray source of claim 1 in which the porous media source includes sintered particles.

3. The electrospray source of claim 2 in which the particles are stainless steel.

4. The electrospray source of claim 3 in which the particles are sintered within the casing.

5. The electrospray source of claim 2 in which the sintered particles have a porosity between 0.5 and 20 microns.

6. The electrospray source of claim 2 in which the casing is made of the same materials as the sintered particles.

7. The electrospray source of claim 2 in which the sintered particles are attached to the casing.

8. The electrospray source of claim 1 in which the surface of the porous flow distributor has a concave shape.

9. The electrospray source of claim 1 in which the extractor is made of a conductive material.

10. The electrospray source of claim 1 in which the guard electrode is made of a conductive material.

11. The electrospray source of claim 1 further including a dielectric isolator between the extractor and the emitter.

12. The electrospray source of claim 1 further including a channel located within the porous media, said channel extending from the inlet to the surface and configured for the working fluid to flow therethrough.

13. The electrospray source of claim 1 in which the working fluid is non-metallic.

14. The electrospray source of claim 1 configured as a thruster.

15. An electrospray source emitter comprising:

a casing about a porous media flow distributor for controlling the direction of a working fluid, the porous media flow distributor including an inlet at one end thereof for intake of said working fluid, and a surface including particles at the other end thereof, said particles serving as electric field concentration points to form multiple Taylor cones when the working fluid flows through the porous media; and a guard electrode surrounding the casing.

16. The emitter of claim 15 further including an extractor at a potential different than the emitter for forming the Taylor cones.

17. The emitter of claim 16 in which the guard electrode is spaced from the casing and is between the emitter and the extractor and at or above the potential of the emitter for shaping the electric field formed between the emitter and the extractor.

18. The emitter of claim 17 further including a dielectric isolator between the extractor and the emitter.

19. The electrospray source emitter of claim 15 further including a channel located within the porous media frit, said channel extending from the inlet to the surface and configured for the working fluid to flow therethrough.

20. A method of producing multiple Taylor cones of a working fluid, the method comprising:

driving the working fluid through a porous media frit with an inlet at one end thereof for intake of the working fluid and a surface including particles at the other end thereof, said particles serving as electric field concentration points to form the multiple Taylor cones;

controlling the direction of the working fluid through the porous media frit with a casing; and disposing a guard electrode surrounding the casing for producing an electric field to form multiple Taylor cones of the working fluid emitted from the porous media.

21. The method of claim 20 further including shaping the electric field.

22. The method of claim 20 in which the electric field produced is an axial electric field.

23. An electrospray source configured as a thruster comprising:

an emitter including:

a porous media flow distributor with an inlet at one end thereof for working fluid intake, a surface including particles at the other end thereof, said particles serving as electric field concentration points to form multiple Taylor cones in said working fluid;

a channel located within the porous media flow distributor, said channel extending from the inlet to the surface and configured for the working fluid to flow therethrough; and a casing about the porous media flow distributor for controlling the direction of said working fluid through the porous media;

an extractor at a potential different than the emitter for forming the Taylor cones; and a guard electrode surrounding the casing but spaced from the casing and between the emitter and the extractor, said guard electrode at or above the potential of the emitter for shaping the electric field formed between the emitter and the extractor.

* * * * *